US011289068B2

(12) United States Patent
Wang et al.

(10) Patent No.: US 11,289,068 B2
(45) Date of Patent: Mar. 29, 2022

(54) METHOD, DEVICE, AND COMPUTER-READABLE STORAGE MEDIUM FOR SPEECH SYNTHESIS IN PARALLEL

(71) Applicant: BAIDU ONLINE NETWORK TECHNOLOGY (BEIJING) CO., LTD., Beijing (CN)

(72) Inventors: Wenfu Wang, Beijing (CN); Chenxi Sun, Beijing (CN); Tao Sun, Beijing (CN); Xi Chen, Beijing (CN); Guibin Wang, Beijing (CN); Lei Jia, Beijing (CN)

(73) Assignee: BAIDU ONLINE NETWORK TECHNOLOGY (BEIJING) CO., LTD., Beijing (CN)

( * ) Notice: Subject to any disclaimer, the term of this patent is extended or adjusted under 35 U.S.C. 154(b) by 24 days.

(21) Appl. No.: 16/874,585

(22) Filed: May 14, 2020

(65) Prior Publication Data

US 2020/0410979 A1 Dec. 31, 2020

(30) Foreign Application Priority Data

Jun. 27, 2019 (CN) ..... 201910569448.8

(51) Int. Cl.

| | |
|---|---|
| ***G10L 13/00*** | (2006.01) |
| ***G10L 13/02*** | (2013.01) |
| ***G10L 13/10*** | (2013.01) |
| ***G10L 13/047*** | (2013.01) |

(52) U.S. Cl.

CPC ..... *G10L 13/047* (2013.01); *G10L 13/10* (2013.01)

(58) Field of Classification Search

CPC ..... G10L 13/02; G10L 13/07; G10L 13/10; G10L 13/00

See application file for complete search history.

(56) References Cited

U.S. PATENT DOCUMENTS

| | | | | |
|---|---|---|---|---|
| 5,913,194 | A * | 6/1999 | Karaali | G10L 13/02 704/259 |
| 11,049,006 | B2 * | 6/2021 | Langford | G06N 7/005 |
| 2002/0029146 | A1 * | 3/2002 | Nir | G09B 15/023 704/260 |

(Continued)

FOREIGN PATENT DOCUMENTS

| | | |
|---|---|---|
| JP | 2019032529 A | 2/2019 |
| JP | 2019045856 A | 3/2019 |

OTHER PUBLICATIONS

Japanese Patent Application No. 2020-068909, English translation of Office Action dated Apr. 27, 2021, 2 pages.

(Continued)

*Primary Examiner* — Shreyans A Patel

(74) *Attorney, Agent, or Firm* — Lathrop GPM LLP

(57) ABSTRACT

The disclosure provides a method, an apparatus, a device, and a computer-readable storage medium for speech synthesis in parallel. The method includes: splitting a piece of text into a plurality of segments; based on the piece of text, obtaining a plurality of initial hidden states of the plurality of segments for a recurrent neural network. The method further includes: synthesizing the plurality of segments in parallel based on the plurality of initial hidden states and input features of the plurality of segments.

18 Claims, 4 Drawing Sheets

(56) References Cited

U.S. PATENT DOCUMENTS

| | | | | |
|---|---|---|---|---|
| 2009/0048841 | A1* | 2/2009 | Pollet | G10L 13/07 704/260 |
| 2018/0082675 | A1* | 3/2018 | Wang | G10L 13/10 |
| 2020/0051583 | A1* | 2/2020 | Wu | G06N 5/046 |

OTHER PUBLICATIONS

Japanese Patent Application No. 2020-068909, Office Action dated Apr. 27, 2021, 2 pages.

* cited by examiner

METHOD, DEVICE, AND COMPUTER-READABLE STORAGE MEDIUM FOR SPEECH SYNTHESIS IN PARALLEL

CROSS-REFERENCE TO RELATED APPLICATION

This application claims priority to Chinese Patent Application No. 201910569448.8 filed on Jun. 27, 2019, the entire contents of which are incorporated herein by reference.

FIELD

Embodiments of the disclosure generally relate to the field of speech synthesis technology, and more particularly to a method, a device, and a computer-readable storage medium for speech synthesis in parallel by utilizing a recurrent neural network (RNN).

BACKGROUND

Speech synthesis refers to a technology of converting a text into a speech, also known as text-to-speech (TTS). Generally, the speech synthesis technology converts text information into speech information with a good sound quality and a high natural fluency through a computer. The speech synthesis is one of core technologies of an intelligent speech interaction technology, and forms an indispensable part of the intelligent speech interaction technology together with a speech recognition technology.

Conventional speech synthesis mainly includes a speech synthesis method based on vocoder parameters and a speech synthesis method based on unit selection and splicing. Generally, a quality of the speech synthesis (including a sound quality and a natural fluency) directly affects a hearing sense of a user and a user experience of a related product. In recent years, with the development of depth learning technology and the wide application of depth learning technology in the field of speech synthesis, the sound quality and the natural fluency of the speech synthesis are significantly improved. In addition, with the rapid popularization of intelligent hardware, a scene where the speech synthesis is utilized to obtain information becomes more and more abundant. Presently, the speech synthesis is widely used in the field such as speech broadcasting, map navigation and intelligent customer service, and in the product such as an intelligent speaker.

SUMMARY

In a first aspect of the disclosure, there is provided a method for speech synthesis in parallel. The method includes: splitting a piece of text into a plurality of segments; based on the piece of text, obtaining a plurality of initial hidden states of the plurality of segments for a recurrent neural network; and synthesizing the plurality of segments in parallel based on the plurality of initial hidden states and input features of the plurality of segments.

In a second aspect of the disclosure, there is provided a device. The device includes: one or more processors and a memory. The memory is configured to store one or more programs. When the one or more programs are executed by the one or more processors, the one or more processors are caused to implement the method or the procedure according to embodiments of the disclosure.

In a third aspect of the disclosure, there is a computer-readable storage medium having computer programs stored thereon. When the computer programs are executed by a processor, the method or the procedure according to embodiments of the disclosure is implemented.

It should be understood that, descriptions in Summary of the disclosure are not intended to limit essential or important features in embodiments of the disclosure, and are also not construed to limit the scope of the disclosure. Other features of the disclosure will be easily understood by following descriptions.

BRIEF DESCRIPTION OF THE DRAWINGS

The above and other features, advantages and aspects of respective embodiments of the disclosure will become more apparent with reference to accompanying drawings and following detailed illustrations. In the accompanying drawings, the same or similar numeral references represent the same or similar elements, in which.

DETAILED DESCRIPTION

Figure 1:
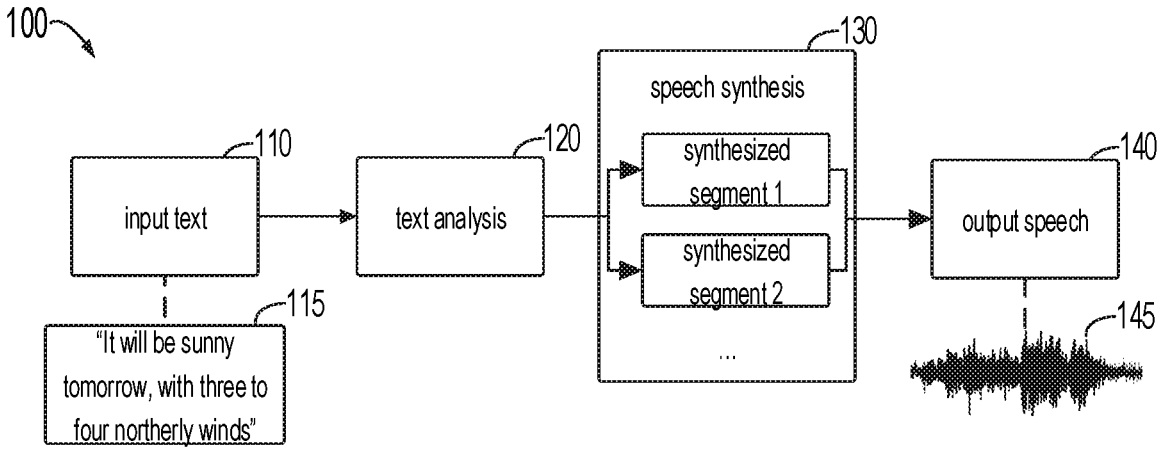
FIG. 1 is a schematic diagram illustrating an exemplary scene for speech synthesis in parallel according to embodiments of the disclosure.

Description will be made in detail below to embodiments of the disclosure with reference to accompanying drawings. Some embodiments of the disclosure are illustrated in the accompanying drawings. It should be understood that, the disclosure may be implemented in various ways, but not be construed as a limitation herein. On the contrary, those embodiments provided are merely for a more thorough and complete understanding of the disclosure. It should be understood that, the accompanying drawings and embodiments of the disclosure are merely for exemplary purposes, but are not meant to limit the scope of the disclosure.

In the description of embodiments of the disclosure, term "include" and its equivalents should be understood as an inclusive meaning, that is, "include but not limited to". Term "based on" should be understood as "based at least in part". Term "an embodiment" or "the embodiment" should be understood as "at least one embodiment". Term "some embodiments" should be understood as "at least some embodiments". Other explicit and implicit definitions may also be included below.

Conventional speech synthesis systems may mainly include two types: a parameter system based on vocoder and a waveform splicing system based on unit selection. The parameter system based on vocoder firstly maps a text input representation into acoustic parameters such as spectrum and fundamental frequency, and then converts the acoustic parameters into a speech by using the vocoder. The waveform splicing system based on unit selection also maps the text input representation into the acoustic parameters such as spectrum and fundamental frequency, and selects an optimal waveform segment sequence from a speech library by combining text rules and unit selection strategies such as an acoustic target cost and a connection cost, and then splices the selected segments into a target speech. The parameter system based on vocoder has a high natural fluency due to using an acoustic model to predict the acoustic parameters. However, according to a human pronunciation mechanism, the vocoder is a simplified algorithm designed based on an acoustic source-channel model, causing a low sound quality of a speech synthesized by the parameter system. The waveform splicing system based on unit selection directly selects original speech segments from the speech library, thereby ensuring a high sound quality. However, once the speech segments are not selected well, the splicing is not continuous, and a natural fluency is often not high. Therefore, it may be seen that, it is difficult for the conventional speech synthesis systems to give attention to both the sound quality and the natural fluency. The quality of the synthesized speech is far from that of the natural speech, which is a lower.

In recent years, the improvement of the conventional speech synthesis systems is a neural TTS (text to speech) system based on a depth learning technology. The neural TTS system may directly model speech sample points by using a learnable depth model, thereby avoiding a complex design for the conventional synthesis systems and greatly improving the sound quality and the natural fluency of the synthesized speech. The speech synthesized by the neural speech synthesis not only has a good sound quality but also has a high fluency. However, the neural speech synthesis generally uses a stacked multi-layer network structure or a complex structure to model the speech sampling points, such that it needs a large calculation amount for generating the speech sampling points at each step. Therefore, the neural speech synthesis has a high computational cost. Taking a speech synthesis system based on RNN (recurrent neural network) as an example, the RNN generates a speech step by step in a serial manner. For example, every time 1 second of speech with a sample frequency being 16000 is generated, a forward calculation for 16000 times need to be done in turn, and a normal calculation duration may be much longer than 1 second. This high latency causes an extremely low real-time rate. Therefore, with the speech synthesis system based on the RNN, although the synthesized speech has a high quality, a requirement for real-time speech synthesis is hard to meet due to the large calculation amount and single-point recursion of the speech synthesis system based on RNN.

In order to realize the real-time speech synthesis based on RNN, main improvement methods include the following. First, a calculation amount of a single-step operation is reduced. A most direct way is to reduce a dimension of hidden layers, but a performance loss may be caused directly and the quality of the synthesized speech may be significantly declined. Another way is to reduce the number of non-zero weights by performing sparsification on a weight matrix, which may maintain the dimension of the hidden layers unchanged and a representation ability of the hidden layers. In addition, a sigmoid or tan h nonlinear function of an original gating recurrent unit (GRU) may also be replaced by a nonlinear function (e.g., a softsign function) with a lower calculation complexity. However, the above simplified processing for reducing the calculation amount of the single-step operation may bring the performance loss. Second, a kernel optimization is performed on a graphic processing unit (GPU). An ordinary GPU implementation cannot directly achieve a fast real-time synthesis, main bottlenecks of which are a bandwidth limitation of communication between a video memory and a register, and an overhead caused by initiating a kernel operation each time. In order to improve the calculation efficiency of the GPU, on the one hand, the number of times that the register copies data from the video memory may be reduced, and model parameters may be read to the registers at one time, in which, one limitation is that the number of registers needs to match the number of the model parameters; on the other hand, the number of times that the kernel operation is initiated is reduced, and once all the model parameters may be read into the registers, generating the sample points of a whole sentence may be optimized and merged into one kernel operation, thereby avoiding the overhead caused by initiating a large number of kernel operations. In addition, a GPU with a high-performance calculating architecture is needed to support a real-time calculation, causing a high hardware cost. Third, sample points are generated through subscale batch. A subscale strategy decomposes and simplifies a probability of a sample point sequence, and supports to generate a plurality of sample points in parallel. However, in this way, a timing dependency of the sampling points is destroyed, and an interruption of hidden states for the RNN is caused, thereby causing the performance loss. In addition, the subscale has a disadvantage of a hard delay of a first packet. In a scene with a high real-time performance of the first packet, the subscale may bring about a great delay. Therefore, it may be seen that, although the above three improved methods may speed up the speech synthesis by the strategy such as simplifying the calculation amount of the model at a single step, accelerating an optimization of hardware with a high performance, or generating subscale batch sample points, all of strategies may come at the expense of the sound quality, causing a poor quality of the synthesized speech.

The inventors of the disclosure have noticed that the RNN has a natural timing dependence (such as a hidden state connection), which determines that the RNN is theoretically difficult to execute in parallel and may generate results step by step only. In order to implement the real-time speech synthesis based on RNN, embodiments of the disclosure provide a solution for speech synthesis in parallel based on a continuity of hidden states of segments. With embodiments of the disclosure, during a plurality of segments are synthesized in parallel using the RNN, by providing an initial hidden state for each segment through a hidden state prediction model, a speed of the speech synthesis may be improved and the speech synthesis may be implemented in real time, and also the interruption of the hidden states among the segments may be relieved, thus ensuring the quality of the synthesized speech by ensuring the continuity of hidden states inside the RNN.

A technology for real-time speech synthesis in parallel using an RNN based on the continuity of hidden states of segments according to the disclosure creatively solves a problem of using RNN for online real-time synthesis, and significantly improves the speed of RNN synthesis. With the solution of the disclosure, not only may a high quality of the synthesized speech be ensured, but also an online deployment with a large scale is supported. In some embodiments, the parallel RNN synthesis technology provided by the disclosure takes segments (e.g., phonemes, syllables, words, etc.) as basic synthesis units, a plurality of segments are synthesized in parallel, and each segment is synthesized serially in an autoregressive manner. Moreover, in order to ensure the continuity of RNN hidden states among the plurality of segments, the disclosure provides an initial hidden state for each segment by using a hidden state prediction network, effectively solving the interruption of the RNN hidden states caused by synthesizing in parallel, and ensuring the high quality of synthesizing in parallel. The parallel real-time RNN speech synthesis technology based on the continuity of hidden states of segments clears an obstacle of performing the speech synthesis in real time by using the RNN, and greatly promotes a speech synthesis transformation from the conventional parameter system and the splicing system to the neural speech synthesis system.

FIG. 1 is a schematic diagram illustrating an exemplary scene 100 for speech synthesis in parallel according to embodiments of the disclosure. It should be understood that, the scene 100 is an exemplary scene which may be implemented according to embodiments of the disclosure, and does not limit a protection scope of the disclosure. As illustrated in FIG. 1, for an input text 110 (such as a text 115 "It will be sunny tomorrow, with three to four northerly winds") of a speech to be synthesized, a text analysis is performed on the input text 110 at block 120 firstly. For example, a grapheme-to-phoneme conversion may be performed on the input text 110 to determine a pronunciation of each character, and a pronunciation of a polyphone may be predicted in a case that the polyphone exists. In addition, a prosodic analysis may be performed on the input text to mark prosodic information such as a stress and a pause.

A speech synthesis is executed at block 130. In embodiments of the disclosure, a procedure for the speech synthesis is performed by using a speech synthesis model based on the RNN, such as a Wave RNN model. It should be understood that, any speech synthesis model based on the RNN known or future developed may be used in conjunction with embodiments of the disclosure. In embodiments of the disclosure, since an initial RNN hidden state of each segment may be predicted and obtained, a plurality of segments may be synthesized in parallel without affecting the sound quality. In the context of the disclosure, the term "initial hidden state" may refer to the initial hidden state of each segment in the RNN when respective segments are synthesized. As illustrated in FIG. 1, embodiments of the disclosure may simultaneously synthesize a segment 1, a segment 2, etc., to obtain an output speech 140, such as a speech 145. An example implementation for speech synthesis in parallel is described below with reference to FIGS. 2-8.

It should be understood that, a method for speech synthesis in parallel according to embodiments of the disclosure may be disposed in various electronic devices. For example, in the scene of a client-server architecture, the method for speech synthesis in parallel according to embodiments of the disclosure may be implemented on a client side, or a server side. Alternatively, the method for speech synthesis in parallel according to embodiments of the disclosure may also be implemented partly on the client side and partly on the server side.

Figure 2:
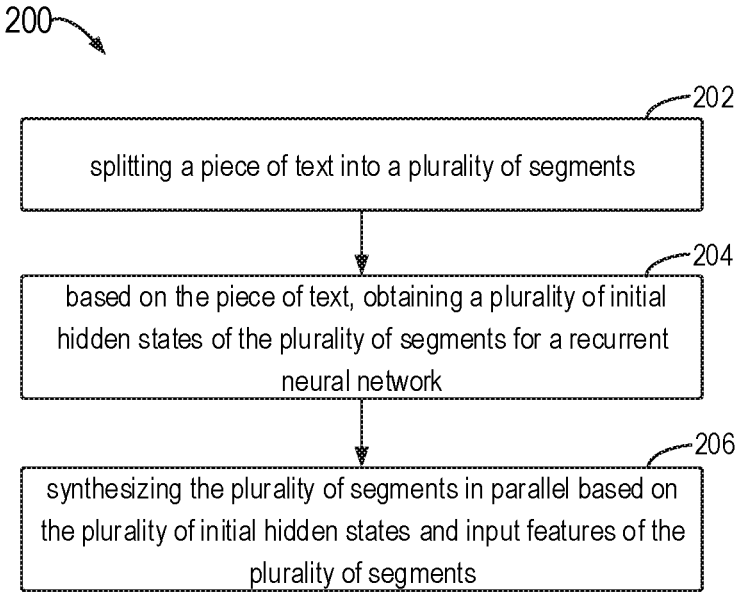
FIG. 2 is a flow chart illustrating a method for speech synthesis in parallel according to embodiments of the disclosure.

FIG. 2 is a flow chart illustrating a method 200 for speech synthesis in parallel according to embodiments of the disclosure. In order to facilitate a clear description for the method 200, the method 200 is described herein with reference to a procedure 300 for speech synthesis in parallel in FIG. 3.

Figure 3:
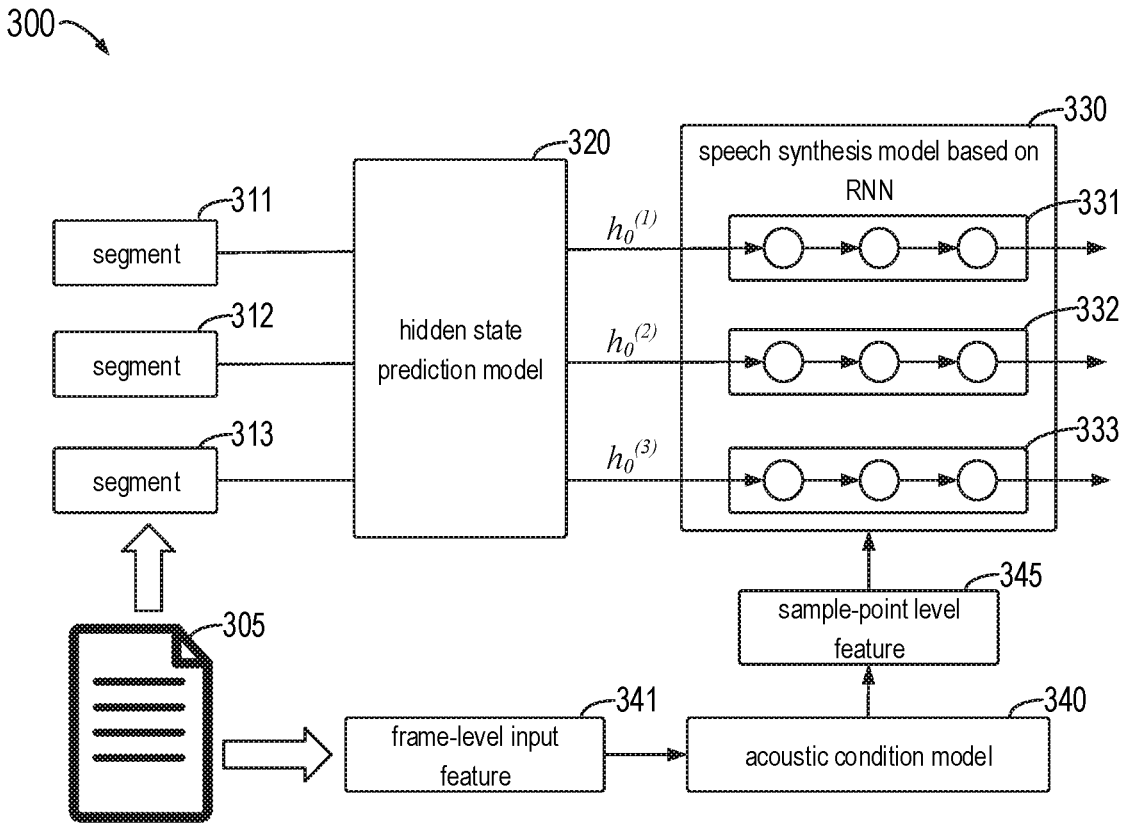
FIG. 3 is a schematic diagram illustrating a procedure for synthesizing segments in parallel and in real time based on a continuity of a hidden state of each segment according to embodiments of the disclosure.

At block 202, a piece of text is split into a plurality of segments. For example, as illustrated in FIG. 3, a text 305 to be synthesized is divided into a plurality of segments, such as segments 311, 312, and 313. In some embodiments, each segment may be any of a phoneme, a syllable and a prosodic word, or even a larger pronunciation unit. The phoneme is a smallest unit constituting the syllable, which is the smallest phonetic segment. The phoneme has two categories, i.e., a vowel and a consonant. The syllable is a basic pronunciation unit, which may include one or more phonemes. For example, in Chinese, a Chinese character may be one syllable. The prosodic word refers to a word defined according to prosody, which may include a plurality of syllables. It should be understood that the segment in embodiments of the disclosure may also be the larger pronunciation unit. For example, when each segment is the syllable, the text (e.g. a Chinese text) is split according to each Chinese character, and one syllable (corresponding to one Chinese character) is one segment.

At block 204, based on the piece of text, a plurality of initial hidden states of the plurality of segments for a recurrent neural network are obtained. For example, as illustrated in FIG. 3, a hidden state prediction model 320 according to embodiments of the disclosure may predict an initial hidden state of each segment for the RNN, such that the initial hidden state is used in a subsequent parallel speech synthesis. The RNN has a natural timing dependence, and a calculation at a current time usually needs a hidden state generated at a previous time, such that a conventional method may cause an interruption of the hidden states when the speech synthesis is performed in parallel. On the contrary, embodiments of the disclosure may predict the initial hidden state of each segment in advance by using a pre-trained hidden state prediction model 320 without waiting for completing speech synthesis at the previous time before performing the subsequent parallel speech synthesis. In this way, the continuity of the hidden states may be ensured.

At block 206, the plurality of segments are synthesized in parallel based on the plurality of initial hidden states and input features of the plurality of segments. As illustrated in FIG. 3, the speech synthesis model 330 based on the RNN may synthesize the plurality of segments simultaneously based on the initial hidden state of each segment without waiting for completing the speech synthesis for a previous segment before synthesizing a next segment. Therefore, embodiments of the disclosure provides the initial hidden state for each segment through the hidden state prediction model, which may improve a speed of the speech synthesis and implement the speech synthesis in real time, and also may alleviate the interruption of hidden states of the plurality of segments, thereby ensuring the quality of synthesized speech.

Therefore, embodiments of the disclosure provide a technology for real-time speech synthesis in parallel using the RNN based on the continuity of hidden states of the segments. The technology takes the segments of the speech as basic synthesis units of the RNN. Based on the phonetics, the segment may include the phoneme, the syllable, the prosodic words, or even the larger pronunciation unit, etc. The text to be synthesized may be split into the plurality of segments, and then the plurality of segments are synthesized in parallel. Each segment may be synthesized serially in the autoregressive manner. The way of synthesizing in parallel with the segments significantly improves the speed of the speech synthesis based on the RNN and meets a requirement of the speech synthesis in real time. Because of the internal timing dependence, the RNN may only synthesize serially in theory, and the way of synthesizing in parallel with the segments may destroy the continuity of the hidden states of the plurality of segments for the RNN. However, embodiments of the disclosure creatively provide an RNN hidden state prediction method, and the initial hidden state is provided for each segment through the hidden state prediction model, thereby ensuring an approximate continuity of the hidden states of the plurality of segments. In this way, the quality of the synthesized speech is ensured to be lossless while synthesizing the speeches in parallel in real time is implemented. In addition, the technology for real-time speech synthesis in parallel using the RNN based on the continuity of hidden states of the segments may alleviate an error accumulation effect brought by the speech synthesis serially based on the RNN to some certain extent, and may effectively reduce a whistle phenomenon of the synthesized speech.

Referring to FIG. 3, FIG. 3 is a schematic diagram illustrating a procedure 300 for speech synthesis in parallel and in real time based on a continuity of a hidden state of each segment according to embodiments of the disclosure. A text 305 to be synthesized is split into a plurality of segments 311, 312, and 313. A hidden state prediction model 320 may predict initial hidden states $h_0^{(1)}$, $h_0^{(2)}$ and $h_0^{(3)}$ of the segments 311, 312, and 313. It should be understood that, although only 3 segments are illustrated in FIG. 3, the text 305 may be split into more segments.

Referring to FIG. 3, a frame-level input feature 341 of each segment may be extracted from the text 305. For example, each frame may be 5 milliseconds, and each frame is processed by an acoustic condition model, to generate a sample-point level feature 345. The acoustic condition model 340 may model acoustic conditions, and an input of the acoustic condition model may be a linguistic feature of a text. An example structure of the acoustic condition model 340 is described below with reference to FIG. 5.

A speech synthesis model 330 based on the RNN synthesizes respective segments in parallel based on the initial hidden state and the sample-point level feature of each segment. As illustrated in FIG. 3, at block 331, based on the initial hidden state and the sample-point level feature of the segment 311, the speech synthesis is executed for the segment 311; at block 332, based on the initial hidden state and the sample-point level feature of the segment 312, the speech synthesis is executed for the segment 312; and at block 333, based on the initial hidden state and the sample-point level feature of the segment 313, the speech synthesis is executed for the segment 313. In this way, performing the speech synthesis on the segments 311, 312, and 313 in parallel is implemented, and the speech synthesis is speeded up while the quality of the synthesized speech is not sacrificed. After synthesizing respective segments is completed, a speech of each segment may be smoothly connected to obtain a final whole speech.

It should be understood that, a calculation amount introduced by the hidden state prediction model 320 in embodiments of the disclosure is very small and even almost negligible compared with a calculation amount of the RNN. The technology for real-time speech synthesis in parallel using the RNN based on the continuity of hidden states of the segments according to embodiments of the disclosure creatively solves a problem of parallel inference based on the RNN, significantly improves a synthesis efficiency, and ensures that the synthesis quality to be lossless while that a real-time synthesis requirement is met. In addition, compared with a conventional parameter system and a splicing system, embodiments of the disclosure provide a speech synthesis system with a high quality, which is suitable for a wide application of a neural speech synthesis system in industry.

In some embodiments, for a speech synthesis within a single segment, each segment may be synthesized serially in the autoregressive manner. For example, for the procedure of speech synthesis at block 331, FIG. 4 is a block diagram illustrating a procedure 400 for synthesizing a segment serially in an autoregressive manner according to embodiments of the disclosure.

Figure 4:
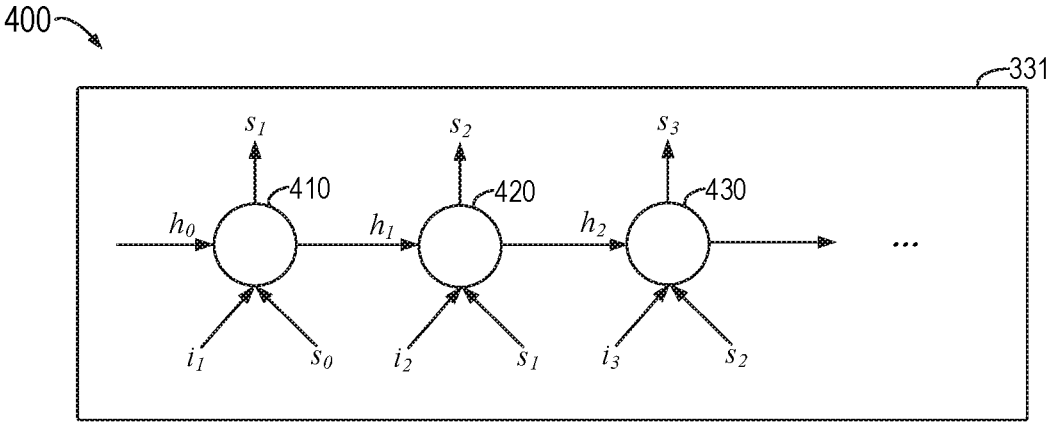
FIG. 4 is a schematic diagram illustrating a procedure for synthesizing a segment serially in an autoregressive manner according to embodiments of the disclosure.

FIG. 4 illustrates an example procedure for generating outputs of sample points 410, 420, 430 and the like in the segment 311. $h_0$ is the initial hidden state of the segment 311, which may be obtained according to the hidden state prediction model 320 of embodiments of the disclosure. In the procedure for generating the sample points in each segment, generating an output of each sample point needs to be based on an input feature of the sample point, an output of the previous sample point and a hidden state transmitted from the previous sample point. For the first sample point 410 in the segment 311, in addition to a feature $i_1$ of the sample point, the input hidden state $h_0$ may be the initial hidden state of the segment 311, the input $s_0$ of the previous sample point may be 0, and the output is $s_1$. Next, For the second sample point 420, the inputs may include the hidden state $h_1$ generated by the previous sample point 410, a feature $i_2$ of the second sample point 420, the output $s_1$ of the previous sample point 410. Through the speech synthesis serially in the autoregressive manner within the single segment, the quality of the synthesized speech of each segment may be ensured.

Figure 5:
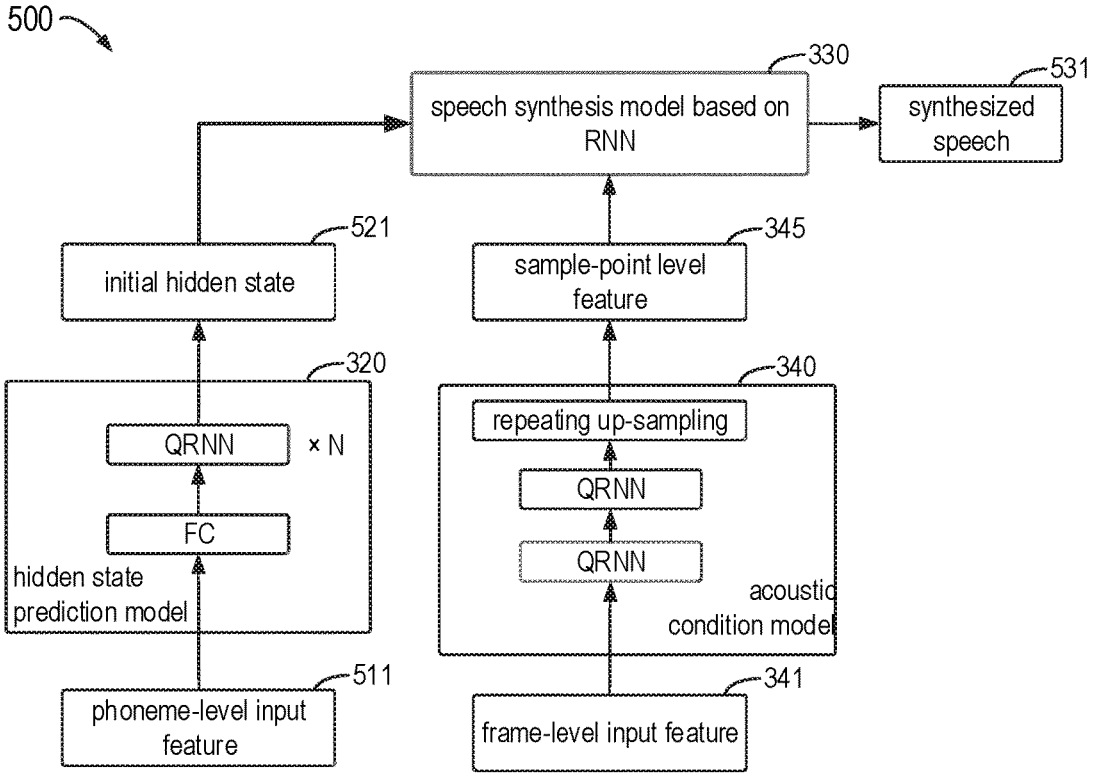
FIG. 5 is a schematic diagram illustrating an exemplary structure of a speech synthesis system based on an RNN according to embodiments of the disclosure.

FIG. 5 is a schematic diagram illustrating an exemplary structure 500 of a speech synthesis system based on an RNN according to embodiments of the disclosure. As illustrated in FIG. 5, the hidden state prediction model 320 may include a fully-connected (FC) layer and N bidirectional quasi-recurrent neural network (QRNN) layers. The acoustic condition model 340 includes 2 bidirectional QRNN layers and 1 repeating up-sampling layer. The speech synthesis model 330 based on the RNN may be implemented by using a 1-layer gating recurrent unit (GRU). It should be understood that the architecture illustrated in FIG. 5 is merely exemplary, and other suitable architectures may also be used in combination with embodiments of the disclosure.

Referring to FIG. 5, after a phoneme-level input feature 511 and a frame-level input feature 341 of each segment are obtained, the hidden state prediction model 320 predicts an initial hidden state 521 of each phoneme based on the phoneme-level input feature 511. Then, an initial hidden state of a first phoneme in the segment is determined as the initial hidden state of the segment. Since the number of phonemes in a language is smaller than the number of syllables, the hidden state prediction model 320 may be more easily trained by using the phoneme-level input feature, thereby predicting a more accurate initial hidden state.

The acoustic condition model 340 obtains a sample-point level feature 345 by repeating the up-sampling method based on the frame-level input feature 341. For example, when each frame feature corresponds to 80 speech sample points, 80 copies of the frame-level feature may be made through repeating up-sampling and the 80 copies are taken as a condition input of the speech synthesis model 330 based on the RNN. The speech synthesis model 330 based on the RNN performs the speech synthesis on respective segments based on the initial hidden state 521 and the sample-point level feature 345, thereby obtaining an output synthesized speech 531.

Figure 6:
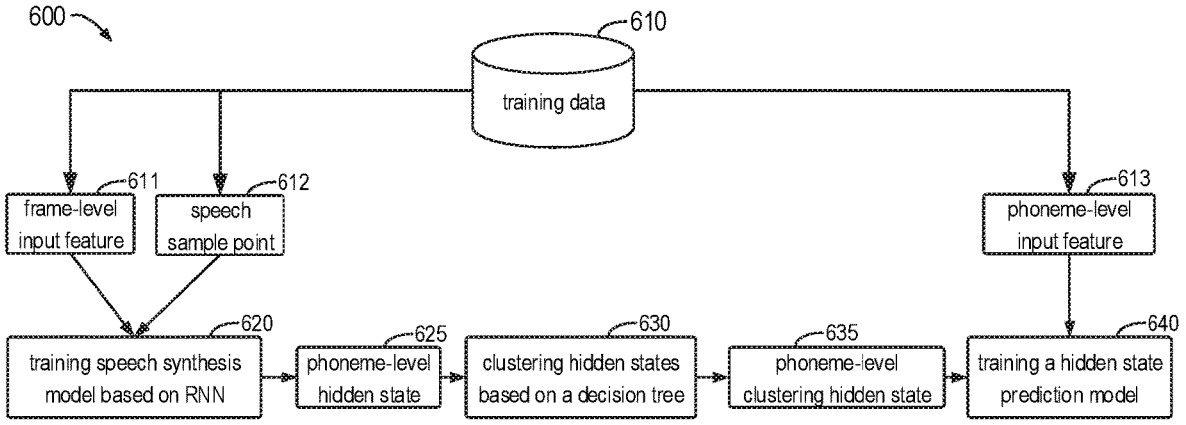
FIG. 6 is a schematic diagram illustrating a training procedure for a speech synthesis system based on an RNN according to embodiments of the disclosure.

Embodiments of the disclosure adds the hidden state prediction model to the conventional speech synthesis model based on the RNN, and the hidden state prediction model and the conventional speech synthesis model based on the RNN may be trained together or separately. FIG. 6 is a schematic diagram illustrating a separately training procedure 600 for a speech synthesis system based on the RNN according to embodiments of the disclosure. For example, the speech synthesis model based on the RNN is trained by using training data firstly. After training the speech synthesis model based on the RNN, the hidden state training model is trained by using the training data and the trained RNN.

Referring to FIG. 6, the training data 610 may include a training text and a training speech corresponding to the training text. A frame-level input feature 611, a speech sample point 612 and a phoneme-level input feature 613 may be extracted from the training data 610. The frame-level input feature 611 and the phoneme-level input feature 613 may be obtained from the training text. The speech sample point 612 may be obtained by sampling from the training speech. In some embodiments, the frame-level input feature 611 may include phoneme context, prosody context, a frame position, a fundamental frequency, etc., while the phoneme-level input feature 613 may include text-level information such as the phoneme context and the prosody context.

In the separately training procedure illustrated in FIG. 6, the speech synthesis model 330 based on the RNN may be trained by using the frame-level input feature 611 and the speech sample point 612 at block 620. Then, a phoneme-level hidden state 625 may be obtained based on the trained speech synthesis model 330 based on the RNN. For example, an initial hidden state of a first sample point of the plurality of sample points corresponding to each phoneme may be determined as the phoneme-level hidden state of the phoneme.

In some embodiments, the hidden state prediction model may be trained by using the phoneme-level hidden state 625 and the phoneme-level input feature 613. The number of phoneme samples in a training set may be relatively small and a dimension of the hidden states is relatively high (e.g. 896 dimensions), and when these hidden states with a high dimension are directly used as targets to train the hidden state prediction model, it is easy to cause model over-fitting. Therefore, in order to improve a training efficiency and a model generalization ability, the phoneme-level hidden states 625 with a high dimension may be clustered by using a decision tree at block 630 to obtain the phoneme-level clustering hidden state 635, thereby reducing the number of hidden states. The clustered hidden states may be obtained by calculating a mean value of all initial hidden states within a class. Next, at block 640, the hidden state prediction model may be trained by using the phoneme-level input feature 613 and the phoneme-level clustering hidden state 635.

In some embodiments, the hidden state prediction model predicts the initial hidden state for each phoneme, and then a corresponding phoneme boundary may be found based on the selected segment, thus the initial hidden state of each segment may be obtained. In addition, the speech synthesis model based on the RNN may be trained by using a cross entropy loss function, while the hidden state prediction model may be trained by employing a L1 loss function.

Figure 7:
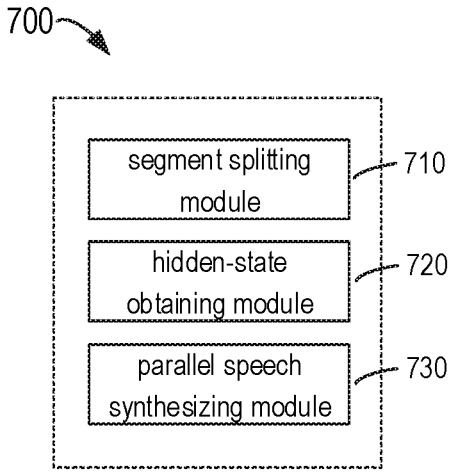
FIG. 7 is a block diagram illustrating an apparatus for speech synthesis in parallel according to embodiments of the disclosure.

FIG. 7 is a block diagram illustrating an apparatus 700 for speech synthesis in parallel according to embodiments of the disclosure. As illustrated in FIG. 7, the apparatus 700 includes a segment splitting module 710, a hidden-state obtaining module 720, and a parallel speech synthesizing module 730. The segment splitting module 710 is configured to split a piece of text into a plurality of segments. The hidden-state obtaining module 720 is configured to, based on the piece of text, obtain a plurality of initial hidden states of the plurality of segments for a recurrent neural network. The parallel speech synthesizing module 730 is configured to synthesize the plurality of segments in parallel based on the plurality of initial hidden states and input features of the plurality of segments.

In some embodiments, each segment in the plurality of segments includes any of a phoneme, a syllable and a prosodic word, and the parallel speech synthesizing module 730 includes: a serially speech synthesizing module, configured to synthesize each segment serially in an autoregressive manner based on the initial hidden state and the input feature of each segment.

In some embodiments, the hidden-state obtaining module 720 includes: a determining module for a phoneme-level input feature and a hidden state prediction module. The determining module for the phoneme-level input feature is configured to determine the phoneme-level input feature of each segment in the plurality of segments. The hidden state prediction module is configured to, based on the phoneme-level input feature of each segment, predict the initial hidden state of each segment by using a hidden state prediction model subjected to training.

In some embodiments, the parallel speech synthesizing module 730 includes: a determining module for a frame-level input feature, an obtaining module for a sample-point level feature and a segment synthesizing module. The determining module for the frame-level input feature is configured to determine the frame-level input feature of each segment in the plurality of segments. The obtaining module for the sample-point level feature is configured to, based on the frame-level input feature, obtain the sample-point level feature by utilizing an acoustic condition model. The segment synthesizing module is configured to, based on the initial hidden state and the sample-point level feature of each segment, synthesize respective segments by using a speech synthesis model based on the recurrent neural network.

In some embodiments, the obtaining module for the sample-point level feature includes: a repeating up-sampling module, configured to obtain the sample-point level feature by repeating up-sampling.

In some embodiments, the apparatus further includes: a training module for a speech synthesis model and a training model for a hidden state prediction model. The training module for the speech synthesis model is configured to train the speech synthesis model based on the recurrent neural network by using training data. The training model for the hidden state prediction model is configured to train the hidden state prediction model by using the training data and the trained speech synthesis model.

In some embodiments, the training module for the speech synthesis model includes: a first obtaining module and a first training module. The first obtaining module is configured to obtain a frame-level input feature of a training text in the training data and a speech sample point of a training speech corresponding to the training text, in which, the frame-level input feature includes at least one of phoneme context, prosody context, a frame position and a fundamental frequency. The first training module is configured to train the speech synthesis model by using the frame-level input feature of the training text and the speech sample point of the training speech.

In some embodiments, the training model for the hidden state prediction model comprises: a second obtaining module, a third obtaining module, and a second training module. The second obtaining module is configured to obtain a phoneme-level input feature of the training text, in which the phoneme-level input feature includes at least one of the phoneme context and the prosody context. The third obtaining module is configured to obtain a phoneme-level hidden state of each phoneme from the trained speech synthesis model. The second training module is configured to train the hidden state prediction model by using the phoneme-level input feature and the phoneme-level hidden state.

In some embodiments, the second training module includes: a hidden-state clustering module and a third training module. The hidden-state clustering module is configured to cluster the phoneme-level hidden state of each phoneme to generate a phoneme-level clustering hidden state. The third training module is configured to train the hidden state prediction model by using the phoneme-level input feature and the phoneme-level clustering hidden state.

In some embodiments, the third obtaining module includes: a determining module for the phoneme-level hidden state, configured to determine an initial hidden state of a first sample point in a plurality of sample points corresponding to each phoneme as the phoneme-level hidden state of each phoneme.

It should be understood that, the segment splitting module 710, the hidden-state obtaining module 720, and the parallel speech synthesizing module 730 illustrated in FIG. 7 may be included in a single or a plurality of electronic devices. It should be understood that, the modules illustrated in FIG. 7 may execute steps or actions according to the method or the procedure of embodiments of the disclosure.

The segment-based RNN parallel synthesis scheme of the embodiments of the disclosure may overcome the problem of low efficiency of RNN serial synthesis, significantly improve the real-time rate of speech synthesis, and thus support the real-time speech synthesis. In addition, in the single-step recursive calculation, there is no need to specialize the model algorithm, so the acceleration cost is lower. Compared with the conventional subscale batch sampling point generation strategy, the segment-based RNN parallel synthesis technology of embodiments of the disclosure may have the advantage of low latency. In the scene where the user requires a high response speed for synthesis, the embodiments of the disclosure has obvious advantages.

In addition, the embodiments of the disclosure use the hidden state prediction model to provide the initial hidden state for each segment, alleviating the interruption of hidden states among segments during parallel synthesis, and ensuring that the sound quality of parallel synthesis is basically the same as that of serial synthesis, while achieving rapid RNN synthesis without sacrificing the synthesis performance. When training the hidden state prediction model, some embodiments of the disclosure use a decision tree to cluster the hidden state of each phoneme, and use the hidden state after clustering as a training target. In this way, the generalization ability of the hidden state prediction model may be improved.

In addition, compared with the parameter system or splicing system, the segment-based RNN parallel synthesis system is a high-quality neural real-time speech synthesis system, which significantly exceeds the parameter system or splicing system in terms of synthesis quality and promotes the widespread application of neural speech synthesis systems in industry.

Figure 8:
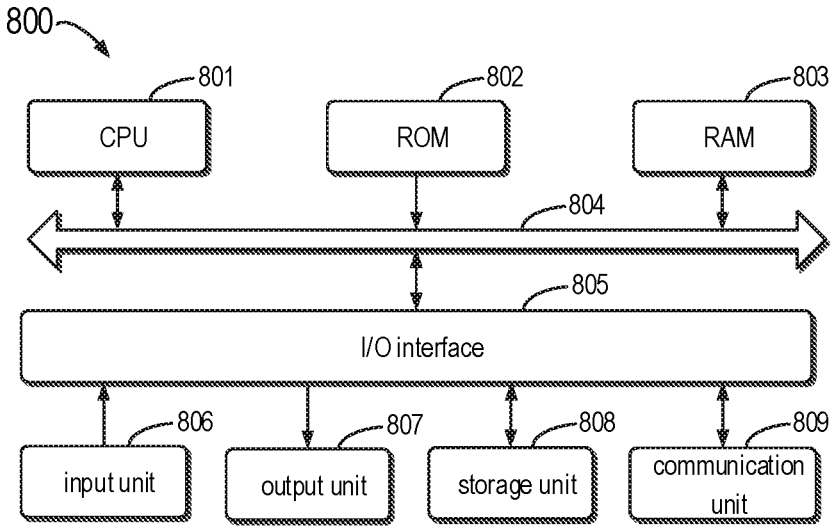
FIG. 8 is a block diagram illustrating an electronic device capable of implementing a plurality of embodiments of the disclosure.

FIG. 8 is a block diagram illustrating an exemplary device 800 capable of implementing embodiments of the disclosure. The device 800 may be configured to implement an apparatus 700 for speech synthesis in parallel according to the disclosure. As illustrated in FIG. 8, the device 800 includes a central processing unit (CPU) 801. The CPU 801 may execute various appropriate actions and processing according to computer program instructions stored in a read only memory (ROM) 802 or computer program instructions loaded to a random-access memory (RAM) 803 from a storage unit 808. The RAM 803 may also store various programs and date required by the device 800. The CPU 801, the ROM 802, and the RAM 803 may be connected to each other via a bus 804. An input/output (I/O) interface 805 is also connected to the bus 804.

A plurality of components in the device 800 are connected to the I/O interface 805, including: an input unit 806 such as a keyboard, a mouse; an output unit 807 such as various types of displays, loudspeakers; a storage unit 808 such as a magnetic disk, an optical disk; and a communication unit 809, such as a network card, a modem, a wireless communication transceiver. The communication unit 809 allows the device 800 to exchange information/data with other devices over a computer network such as Internet and/or various telecommunication networks.

The CPU 801 executes the above-mentioned methods and processes, such as the method 200. For example, in some embodiments, the method may be implemented as a computer software program. The computer software program is tangibly contained in a machine readable medium, such as the storage unit 808. In some embodiments, a part or all of the computer programs may be loaded and/or installed on the device 800 through the ROM 802 and/or the communication unit 809. When the computer programs are loaded to the RAM 803 and are executed by the CPU 801, one or more actions or steps of the method described above may be executed. Alternatively, in other embodiments, the CPU 801 may be configured to execute the method 200 in other appropriate ways (such as, by means of hardware).

The functions described herein may be executed at least partially by one or more hardware logic components. For example, without not limitation, exemplary types of hardware logic components that may be used include: a field programmable gate array (FPGA), an application specific integrated circuit (ASIC), an application specific standard product (ASSP), a system on chip (SOC), a complex programmable logic device (CPLD) and the like.

Program codes for implementing the method of the disclosure may be written in any combination of one or more programming languages. These program codes may be provided to a processor or a controller of a general-purpose computer, a special purpose computer or other programmable data processing device, such that the functions/operations specified in the flowcharts and/or the block diagrams are implemented when these program codes are executed by the processor or the controller. These program codes may execute entirely on a machine, partly on a machine, partially on the machine as a stand-alone software package and partially on a remote machine or entirely on a remote machine or entirely on a server.

In the context of the disclosure, the machine-readable medium may be a tangible medium that may contain or store a program to be used by or in connection with an instruction execution system, apparatus, or device. The machine-readable medium may be a machine-readable signal medium or a machine-readable storage medium. The machine-readable medium may include, but not limit to, an electronic, magnetic, optical, electromagnetic, infrared, or semiconductor system, apparatus, or device, or any suitable combination of the foregoing. More specific examples of the machine-readable storage medium may include electrical connections based on one or more wires, a portable computer disk, a hard disk, a RAM, a ROM, an erasable programmable read-only memory (EPROM or flash memory), an optical fiber, a portable compact disk read-only memory (CD-ROM), an optical storage, a magnetic storage device, or any suitable combination of the foregoing.

In addition, although the operations are depicted in a particular order, it should be understood to require that such operations are executed in the particular order illustrated in the drawings or in a sequential order, or that all illustrated operations should be executed to achieve the desired result. Multitasking and parallel processing may be advantageous in certain circumstances. Likewise, although several specific implementation details are included in the above discussion, these should not be construed as limitation of the scope of the disclosure. Certain features described in the context of separate implementations may also be implemented in combination in a single implementation. On the contrary, various features described in the context of the single implementation may also be implemented in a plurality of implementations, either individually or in any suitable sub-combination.

Although the subject matter has been described in language specific to structural features and/or methodological acts, it should be understood that the subject matter defined in the appended claims is not limited to the specific features or acts described above. Instead, the specific features and acts described above are merely exemplary forms of implementing the claims.

What is claimed is:

1. A method for speech synthesis in parallel, comprising:

splitting a piece of text into a plurality of segments;

based on the piece of text, obtaining a plurality of initial hidden states of the plurality of segments for a recurrent neural network, wherein obtaining the plurality of initial hidden states of the plurality of segments for the recurrent neural network comprises: determining a phoneme-level input feature of each segment in the plurality of segments; and based on the phoneme-level input feature of each segment, predicting the initial hidden state of each segment by using a hidden state prediction model subjected to training; and synthesizing the plurality of segments in parallel based on the plurality of initial hidden states and input features of the plurality of segments.

2. The method of claim 1, wherein each segment in the plurality of segments comprises any of a phoneme, a syllable and a prosodic word, and synthesizing the plurality of segments in parallel comprises:

synthesizing each segment serially in an autoregressive manner based on the initial hidden state and the input feature of each segment.

3. The method of claim 1, wherein synthesizing the plurality of segments in parallel comprises:

determining a frame-level input feature of each segment in the plurality of segments;

based on the frame-level input feature, obtaining a sample-point level feature by utilizing an acoustic condition model; and based on the initial hidden state and the sample-point level feature of each segment, synthesizing respective segments by using a speech synthesis model based on the recurrent neural network.

4. The method of claim 3, wherein obtaining the sample-point level feature by utilizing the acoustic condition model comprises:

obtaining the sample-point level feature by repeating up-sampling.

5. The method of claim 1, further comprising:

training a speech synthesis model based on the recurrent neural network by using training data; and training a hidden state prediction model by using the training data and the trained speech synthesis model.

6. The method of claim 5, wherein training the speech synthesis model based on the recurrent neural network comprises:

obtaining a frame-level input feature of a training text in the training data and a speech sample point of a training speech corresponding to the training text, in which, the frame-level input feature comprises at least one of phoneme context, prosody context, a frame position and a fundamental frequency; and training the speech synthesis model by using the frame-level input feature of the training text and the speech sample point of the training speech.

7. The method of claim 6, wherein training the hidden state prediction model comprises:

obtaining a phoneme-level input feature of the training text, in which the phoneme-level input feature comprises at least one of the phoneme context and the prosody context;

obtaining a phoneme-level hidden state of each phoneme from the trained speech synthesis model; and training the hidden state prediction model by using the phoneme-level input feature and the phoneme-level hidden state.

8. The method of claim 7, wherein training the hidden state prediction model further comprises:

clustering the phoneme-level hidden state of each phoneme to generate a phoneme-level clustering hidden state; and training the hidden state prediction model by using the phoneme-level input feature and the phoneme-level clustering hidden state.

9. The method of claim 7, wherein obtaining the phoneme-level hidden state of each phoneme from the trained speech synthesis model comprises:

determining an initial hidden state of a first sample point in a plurality of sample points corresponding to each phoneme as the phoneme-level hidden state of each phoneme.

10. An electronic device, comprising:

one or more processors; and a memory, configured to store one or more programs, wherein when the one or more programs are executed by the one or more processors, the electronic device are caused to implement a method for speech synthesis in parallel, the method comprising:

splitting a piece of text into a plurality of segments;

based on the piece of text, obtaining a plurality of initial hidden states of the plurality of segments for a recurrent neural network, wherein obtaining the plurality of initial hidden states of the plurality of segments for the recurrent neural network comprises: determining a phoneme-level input feature of each segment in the plurality of segments; and based on the phoneme-level input feature of each segment, predicting the initial hidden state of each segment by using a hidden state prediction model subjected to training; and synthesizing the plurality of segments in parallel based on the plurality of initial hidden states and input features of the plurality of segments.

11. The electronic device of claim 10, wherein each segment in the plurality of segments comprises any of a phoneme, a syllable and a prosodic word, and synthesizing the plurality of segments in parallel comprises:

synthesizing each segment serially in an autoregressive manner based on the initial hidden state and the input feature of each segment.

12. The electronic device of claim 10, wherein synthesizing the plurality of segments in parallel comprises:

determining a frame-level input feature of each segment in the plurality of segments;

based on the frame-level input feature, obtaining a sample-point level feature by utilizing an acoustic condition model; and based on the initial hidden state and the sample-point level feature of each segment, synthesizing respective segments by using a speech synthesis model based on the recurrent neural network.

13. The electronic device of claim 12, wherein obtaining the sample-point level feature by utilizing the acoustic condition model comprises:

obtaining the sample-point level feature by repeating up-sampling.

14. The electronic device of claim 10, wherein the method further comprises:

training a speech synthesis model based on the recurrent neural network by using training data; and training a hidden state prediction model by using the training data and the trained speech synthesis model.

15. The electronic device of claim 14, wherein training the speech synthesis model based on the recurrent neural network comprises:

obtaining a frame-level input feature of a training text in the training data and a speech sample point of a training speech corresponding to the training text, in which, the frame-level input feature comprises at least one of phoneme context, prosody context, a frame position and a fundamental frequency; and training the speech synthesis model by using the frame-level input feature of the training text and the speech sample point of the training speech.

16. The electronic device of claim 15, wherein training the hidden state prediction model comprises:

obtaining a phoneme-level input feature of the training text, in which the phoneme-level input feature comprises at least one of the phoneme context and the prosody context;

obtaining a phoneme-level hidden state of each phoneme from the trained speech synthesis model; and training the hidden state prediction model by using the phoneme-level input feature and the phoneme-level hidden state.

17. The electronic device of claim 16, wherein training the hidden state prediction model further comprises:

clustering the phoneme-level hidden state of each phoneme to generate a phoneme-level clustering hidden state; and training the hidden state prediction model by using the phoneme-level input feature and the phoneme-level clustering hidden state.

18. A non-transient computer-readable medium having a computer program stored thereon, wherein when the computer program is executed by a processor, a method for speech synthesis in parallel is implemented, the method comprising:

splitting a piece of text into a plurality of segments;

based on the piece of text, obtaining a plurality of initial hidden states of the plurality of segments for a recurrent neural network, wherein obtaining the plurality of initial hidden states of the plurality of segments for the recurrent neural network comprises: determining a phoneme-level input feature of each segment in the plurality of segments; and based on the phoneme-level input feature of each segment, predicting the initial hidden state of each segment by using a hidden state prediction model subjected to training; and synthesizing the plurality of segments in parallel based on the plurality of initial hidden states and input features of the plurality of segments.

* * * * *